US008215407B2

(12) United States Patent
Dinkins

(10) Patent No.: US 8,215,407 B2
(45) Date of Patent: Jul. 10, 2012

(54) APPARATUS FOR FLUIDIZING FORMATION FINES SETTLING IN PRODUCTION WELL

(75) Inventor: Walter Dinkins, Anchorage, AK (US)

(73) Assignee: Baker Hughes Incorporated, Houston, TX (US)

( * ) Notice: Subject to any disclaimer, the term of this patent is extended or adjusted under 35 U.S.C. 154(b) by 314 days.

(21) Appl. No.: 12/507,724

(22) Filed: Jul. 22, 2009

(65) Prior Publication Data

US 2011/0017459 A1 Jan. 27, 2011

(51) Int. Cl.
*E21B 43/16* (2006.01)

(52) U.S. Cl. ..... 166/371; 166/369

(58) Field of Classification Search ..... 166/112, 166/310, 369

See application file for complete search history.

(56) References Cited

U.S. PATENT DOCUMENTS

| | | | | |
|---|---|---|---|---|
| 313,915 | A | 3/1885 | Bole | |
| 4,267,888 | A * | 5/1981 | Singer | 166/312 |
| 4,580,634 | A * | 4/1986 | Cruise | 166/310 |
| 4,582,131 | A * | 4/1986 | Plummer et al. | 166/68 |
| 4,595,053 | A | 6/1986 | Watkins et al. | |
| 4,911,245 | A | 3/1990 | Adamek et al. | |
| 5,067,734 | A | 11/1991 | Boehm, Jr. | |
| 5,127,457 | A * | 7/1992 | Stewart et al. | 166/306 |
| 5,327,965 | A | 7/1994 | Stephen et al. | |
| 5,456,314 | A | 10/1995 | Boehm, Jr. et al. | |
| 5,464,063 | A | 11/1995 | Boehm, Jr. | |
| 5,469,919 | A | 11/1995 | Carisella | |
| 5,685,369 | A | 11/1997 | Ellis et al. | |
| 5,755,287 | A | 5/1998 | Cain et al. | |
| 5,845,709 | A * | 12/1998 | Mack et al. | 166/302 |
| 6,260,627 | B1 * | 7/2001 | Rivas | 166/369 |
| 6,352,113 | B1 * | 3/2002 | Neuroth | 166/301 |
| 6,403,235 | B1 | 6/2002 | Glidden et al. | |
| 6,843,480 | B2 | 1/2005 | Nelson et al. | |
| 6,915,856 | B2 | 7/2005 | Gentry et al. | |
| 7,055,606 | B2 * | 6/2006 | Goode et al. | 166/369 |
| 7,284,310 | B2 | 10/2007 | Jones et al. | |
| 7,490,676 | B2 | 2/2009 | Nobileau | |
| 7,841,395 | B2 * | 11/2010 | Gay et al. | 166/105 |
| 2008/0078081 | A1 | 4/2008 | Huff et al. | |
| 2008/0105340 | A1 | 5/2008 | Huff et al. | |
| 2008/0105341 | A1 | 5/2008 | Huff et al. | |

* cited by examiner

*Primary Examiner* — Daniel P Stephenson
(74) *Attorney, Agent, or Firm* — Bracewell & Giuliani LLP

(57) ABSTRACT

The present invention relates to a method and apparatus for reducing the occurrences of lateral wellbores being occluded by fines such as sand and silt. More specifically, the invention relates to discharging a portion of the output of an electrical submersible pump through nozzles that pass through the sidewalls of tubing, the tubing being located in the lateral wellbore.

17 Claims, 4 Drawing Sheets

APPARATUS FOR FLUIDIZING FORMATION FINES SETTLING IN PRODUCTION WELL

BACKGROUND OF THE INVENTION

1. Field of the Invention

The present invention relates to an apparatus and method for preventing sand from settling in wellbores. More specifically, the invention relates to using recirculated fluid to prevent sand from settling in lateral wellbore lines.

2. Description of the Related Art

Some oil-bearing geologic formations have a high sand content. One such example is the "oil sands" field in Canada. Minerals such as oil are located within the sand. To produce the minerals, wellbores are drilled into the sand formation and lined with casing. The wellbores are frequently lateral, or horizontal, wellbores through the sand.

To produce the minerals, water is injected into the sand formation. The minerals and water move into the wellbore through perforations in the casing. An electrical submersible pump ("ESP") is suspended from tubing in the wellbore. The ESP is submerged in the wellbore fluid which, in this case, may contain water, oil, and sand. The wellbore fluid enters the pump inlet and is pumped out through the tubing from which the ESP is suspended.

Sand is suspended in the fluids that move into the wellbore. As the fluids move through the wellbore, some of the sand settles out of suspension and forms a packed layer of settled sand in the wellbore. Over time, the wellbore may become so occluded with settled sand that the flow rate through the wellbore is severely reduced. Some lateral wellbores that typically flow more than 3000 barrels of fluid per day ("bfpd") can drop to 700-400 bfpd due to restrictions in the wellbore caused by settled sand. The settled sand must be cleaned out when production drops too low.

To remove the sand, a cleaning tool must be run through the lateral wellbore. The cleaning tool could be a coil that rotates through the wellbore to scarify the sand. The disadvantage of cleaning tools is that they require the ESP to be withdrawn from the wellbore to make room to insert the cleaning tool. Production time is lost during the removal of the ESP, the cleanout process, and the subsequent reinsertion of the ESP. It is desirable to prevent sand from settling in the wellbore during production or be able to clean out the sand without having to withdraw the ESP.

SUMMARY OF THE INVENTION

An electrical submersible pump ("ESP") is lowered into a wellbore and used to pump fluids out of the wellbore. The primary discharge of the ESP is connected to a tubing that runs to the surface. A recirculation discharge is located at or above the primary discharge. The recirculation discharge diverts a portion of the ESP discharge to a length of nozzle tubing located in a lateral line. In some embodiments, the recirculation discharge is connected to a diversion tube, which runs alongside portions of the ESP such as the pump, seal assembly and motor. Below the motor, the diversion tube is coupled to a descending tube, or stinger, that extends below the motor. The descending tube is landed in a sealbore assembly.

A length of nozzle tubing is run through a lateral line before the ESP is placed in the wellbore. The nozzle tubing has a plurality of nozzles distributed axially along its length. Any nozzle density may be used including, for example, one nozzle per linear foot. More or fewer nozzles per linear foot may be used. The sealbore assembly forms one end of the nozzle tubing. The nozzles on the ESP are distributed axially and circumferentially throughout all or one or more portions of the lateral line. The nozzle density may be uniform throughout the axial length of the tubing, or some portions may have a higher or lower density than others. The elevation of the lateral line may vary, such that there are highpoints and low points, or dips, located along the length of the lateral line. The nozzle density may be higher in the low points because sand may be more likely to settle in the low points.

A valve may be located at the recirculation discharge or anywhere along the diversion tube, descending tubing, or any other point prior to the nozzle tubing. The valve may be, for example, a hydraulically actuated valve that is controlled from the surface. The valve may be used to start and stop flow through the nozzle tubing. The valve may also be used to reduce or increase flow from a low flow setting to a high flow setting.

A chemical injection tube, or capillary line, may run from the surface down to the descending tube or down to the nozzle tube. Chemicals may be injected through the cap line into the nozzle tubing to further prevent sand from settling inside the lateral line. The chemicals can include suspension agents, corrosion inhibitors, and friction reducers.

In operation, a portion of high pressure flow from the ESP is diverted through descending tubing into nozzle tubing. The high-pressure flow is discharged through the nozzles, wherein the flow unsettles sand that may have settled in the lateral line. In some embodiments, the nozzles continuously discharge recirculation fluid into the lateral line to prevent sand from settling. In other embodiments, the valve periodically flows the recirculation fluid to unsettle sand that has already settled. A combination of recirculation and periodic bursts of high-pressure flow may be used.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
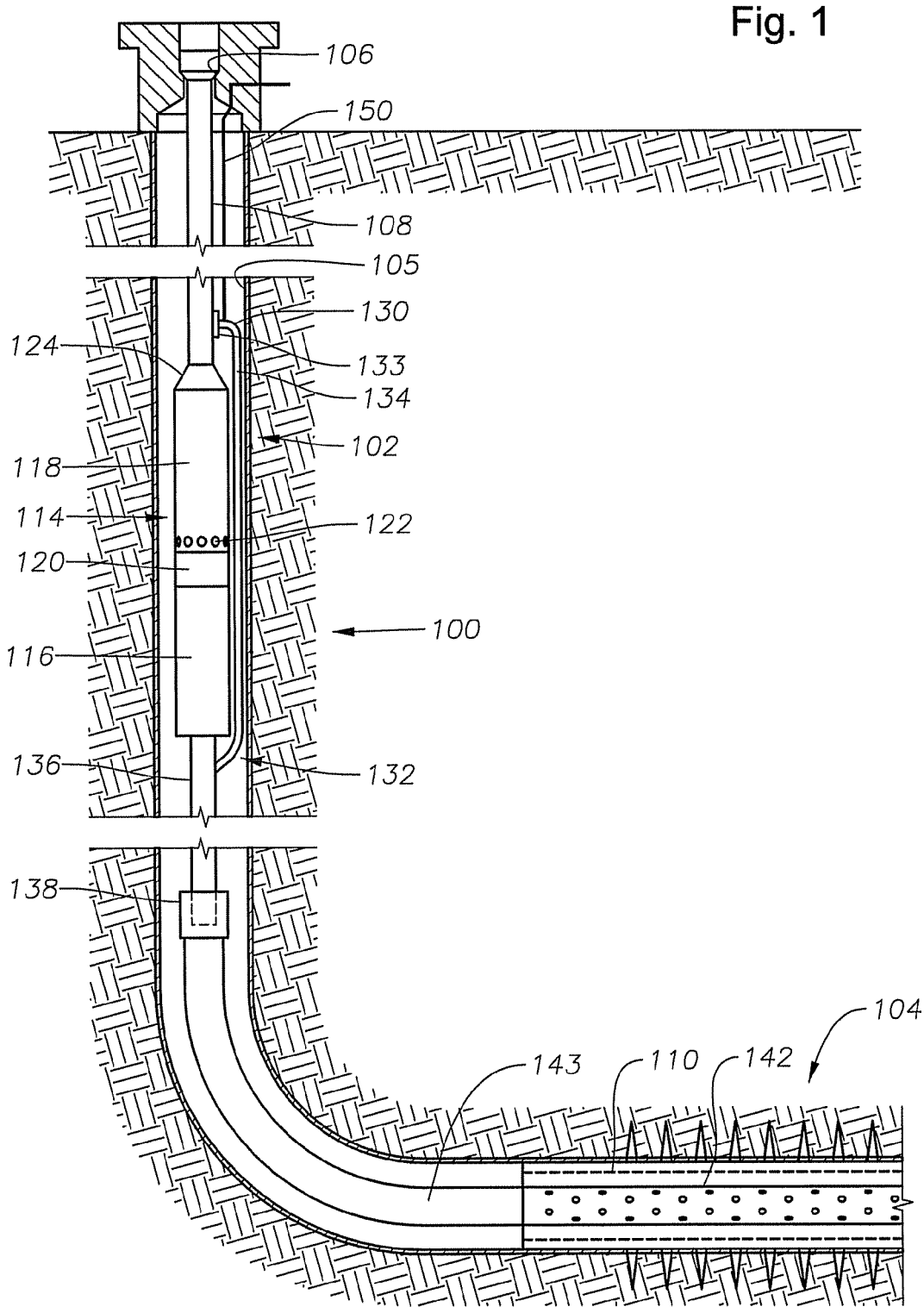
FIG. 1 is a sectional view of an exemplary embodiment of a wellbore fluidizing apparatus.

Referring to FIG. 1, wellbore 100 comprises upper wellbore 102 and lateral line 104. Upper wellbore 102 descends from the surface of the earth to a point where it transitions to lateral line 104. Upper wellbore 102 may be vertical or drilled at an angle. Similarly, lateral line 104 may be at various angles of incline and is not restricted to a horizontal orientation. Furthermore, the direction of the vertical 102 and lateral 104 sections of wellbore 100 may change along the axial length of each. Each section of wellbore 100 may be lined with casing 105. Tubing hangers 106 may be located at the upper end of wellbore 100, including, for example, a wellhead housing located at or near the surface. Tubing 108 may descend from the tubing hanger 106 within the wellbore 100.

Lateral line 104 may extend any distance including, for example, 4000 to 8000 feet through a geologic formation such as an "oil sand" formation. Lateral line 104 may have a slotted or perforated liner 110 to allow well fluids to enter lateral line 104. In an exemplary embodiment, lateral line 104 is lined with a 5½ inch diameter perforated liner 110. Fluids such as oil and water drive fluid may pass through perforated liner 110 into lateral line 104 and subsequently be pumped up to the surface. Solids, such as sand, sediment, and other fines may enter lateral line 104 along with the fluids. The production zone is the area of wellbore 100 through which wellbore fluids are able to pass into wellbore 100. In an exemplary embodiment, the production zone comprises lateral line 104.

Electrical submersible pump ("ESP") 114 may be located within the wellbore 100 to pump fluids up to the surface. In some embodiments, ESP 114 is suspended by and supported on production tubing 108. ESP 114 may be located at any distance above lateral line 104, including, for example, 50-100' true vertical distance ("TVD") above lateral line 104. ESP 114 comprises motor 116, pump 118, and seal section 120. Pump 118 may be a rotary pump, centrifugal pump, or any other type of pump. Pump 118 may comprise multiple stages, wherein each of the intermediate stages comprise a pump that receives fluid from the previous stage and discharges fluid into a succeeding stage. In some embodiments, ESP 114 may be located in lateral line 104.

Inlet 122 located on pump 118 draws fluid into pump 118. Primary discharge 124 located on pump 118 discharges fluid into tubing 108 to be carried to the surface. Recirculation discharge 130 diverts at least a portion of the fluid from pump 118 into recirculation tube assembly 132. Recirculation discharge 130 may be located above primary discharge 124 of pump 118 or may be located between pump stages. Fluid may enter recirculation discharge 130 at a higher pressure if recirculation discharge 130 is located at or above the primary discharge 124 of pump 118. Recirculation discharge 130 is in fluid communication with recirculation tube assembly 132. Discharge control valve 133 may be located at or near recirculation discharge 130, or may be located elsewhere such as along recirculation tube assembly 132. Discharge control valve 133 may be fully open, fully closed, or partially open. In the fully open position, the maximum amount of fluid flows into recirculation tube 132. In the fully closed position, no fluid flows into recirculation tube 132. In the partially open position, some fluid flows into recirculation tube 132, but the volume of fluid is less than when the volume that passes when valve 133 is fully open. In some embodiments, valve 133 may be adjusted throughout a range of partially open positions.

In some embodiments, recirculation tube assembly 132 comprises bypass tube 134 and descending tubing 136. Bypass tube 134 is connected to and in communication with recirculation discharge 130. Bypass tube runs alongside other ESP components such as motor 116 and seal section 120. Depending on the ID of upper wellbore 102 at the ESP 114 location, recirculation tube assembly 132 can have a cylindrical shape, a c-shape, multiple smaller tubes, or any other cross-sectional shape. Bypass tube 134 is connected to and in communication with descending tubing 136. Descending tubing 136 may be any type of pipe or tubing. It descends through the wellbore to sealbore assembly 138.

ESP 114 preferably has a higher flow capacity than is required to pump fluid to the surface to offset the volume of fluid that is diverted by recirculation discharge 130. If, for example, 25% of the flow from ESP 114 is to be diverted to recirculation, then an ESP 114 having a 25% higher capacity may be used so that there is no net loss of production volume reaching the surface.

Some embodiments may use a dedicated recirculation pump (not shown) to pump fluid into recirculation tube assembly 132. A dedicated recirculation pump (not shown) may be located in the wellbore, either in upper wellbore 102 or lateral line 104, or may be located above the surface. In still another embodiment, a pump (not shown) located, for example, on the surface may pump fresh water into recirculation tube assembly 132.

Sealbore assembly 138 is a receptacle for receiving descending tubing 136. In some embodiments, descending tubing 136 terminates in a "stinger" assembly wherein the end of descending tubing 136 is lowered until it lands in sealbore assembly 138. As it lands, the OD of descending tubing 136 contacts inner walls or sealing surfaces of sealbore assembly 138, thereby forming a seal and creating one continuous fluid pathway.

Sealbore assembly 138 forms an end on nozzle tubing 142. In some embodiments, lateral tube 143 is connected between sealbore assembly 138 and nozzle tubing 142. Furthermore, in some embodiments, descending tubing attaches directly to lateral tubing 143 or nozzle tubing 142 without the use of intermediate connectors such as sealbore assembly 138.

Nozzle tubing 142 is tubing that runs through lateral line 104. In some embodiments, nozzle tubing 142 runs the entire length of lateral line 104, and thus nozzle tubing 142 may have an axial length of 4000-8000 feet. In an exemplary embodiment, nozzle tubing 142 has a diameter of 2⅞ inches. In some embodiments, nozzle tubing 142 lays on the bottom of lateral line 104 and thus is not centered within lateral line 104. In some embodiments, a string comprising nozzle tubing 142 and sealbore assembly 138 is first lowered through upper wellbore 102 into lateral line 104. After setting sealbore assembly 138 in vertical wellbore 102 or lateral line 104, a string comprising ESP 114 and recirculation tube assembly 132 is lowered through upper wellbore 102 until descending tubing 136 lands in sealbore assembly 138. In an alternative embodiment, nozzle tubing 142 is attached to descending tubing 136 and lowered through upper wellbore below ESP 114.

Figure 2:
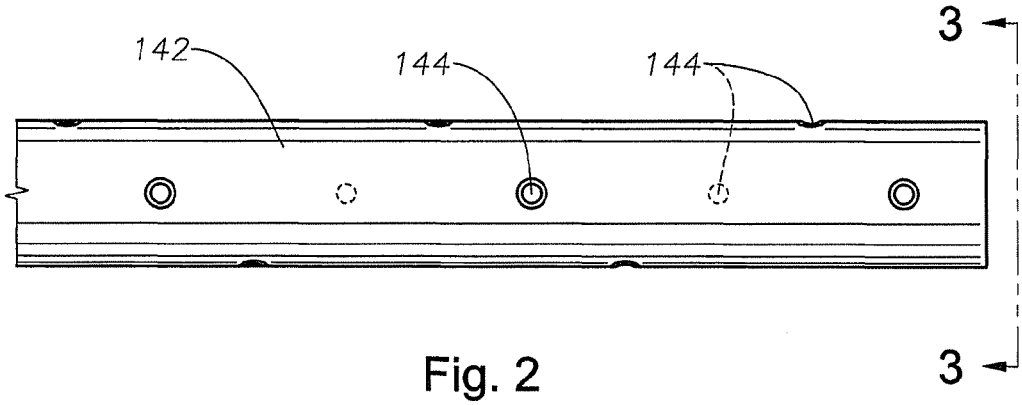
FIG. 2 is a side view of an exemplary embodiment of a recirculation tube of the apparatus of FIG. 1.
Figure 3:
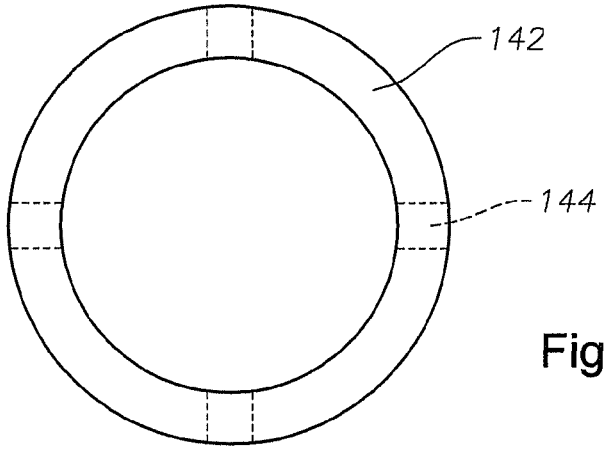
FIG. 3 is a cross sectional view of the recirculation tube of FIG. 2 taken along the 3-3 line.

Referring to FIGS. 2 and 3, discharge apertures 144 are distributed about nozzle tubing 142. Each aperture 144 may be a simple orifice through the sidewall of nozzle tubing 142. Alternatively, each aperture 144 may comprise a nozzle including, for example, nozzles having a conical shape, cylindrical shape, or any other shape to cause fluid to discharge from the aperture 144 at a predetermined direction and velocity. In some embodiments, apertures 144 cause fluid to discharge from nozzle tubing 142 in a direction that is normal to the nozzle tubing 142. In other embodiments, fluid may discharge at an angle, wherein the fluid shoots out of the aperture 144 at an angle in relation to the axis of nozzle tubing 142.

Each aperture 144 may be spaced axially apart along the length of nozzle tubing 142. The density of apertures 144 along nozzle tubing 142 may be constant or may vary along the length of the nozzle tubing 142. In an exemplary embodiment, a first aperture 144 is, for example twelve inches further down the axis of nozzle tubing 142 from the second aperture 144. Thus the aperture 144 density is one aperture 144 per linear foot of nozzle tubing 142. The aperture 144 density may be higher, such as two apertures 144 per linear foot, or may be lower, such as one aperture 144 per two linear feet. In addition to being distributed along the length of nozzle tubing 142, apertures 144 may be distributed about the circumference of nozzle tubing 142. In an exemplary embodiment, each successive aperture 144 is located ¼ of the circumference of nozzle tubing 142 from the previous nozzle. Thus a first nozzle 142 is located at the twelve o'clock position and the second nozzle 142 is at the three o'clock position.

Figure 4:
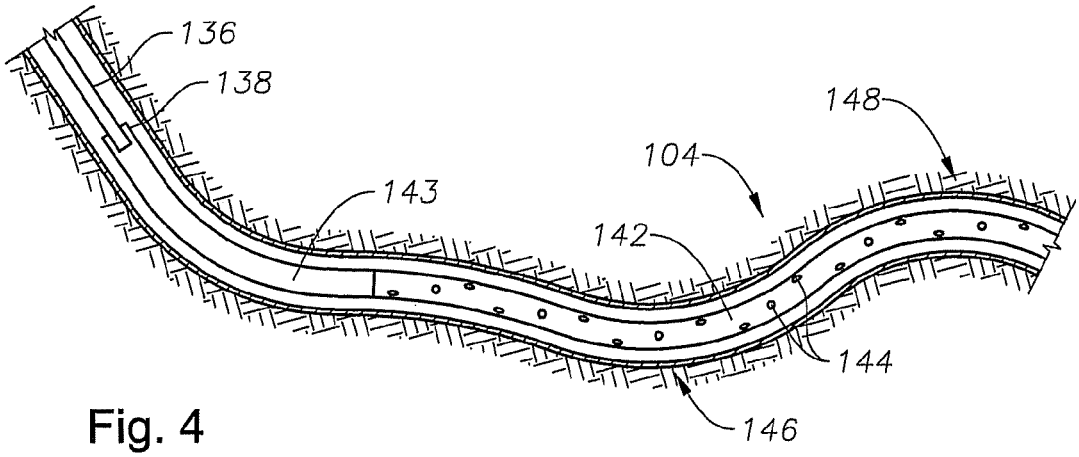
FIG. 4 is a sectional view of an exemplary embodiment of the wellbore fluidizing apparatus of FIG. 1 in a wellbore having low spots and high spots.
Figure 6:
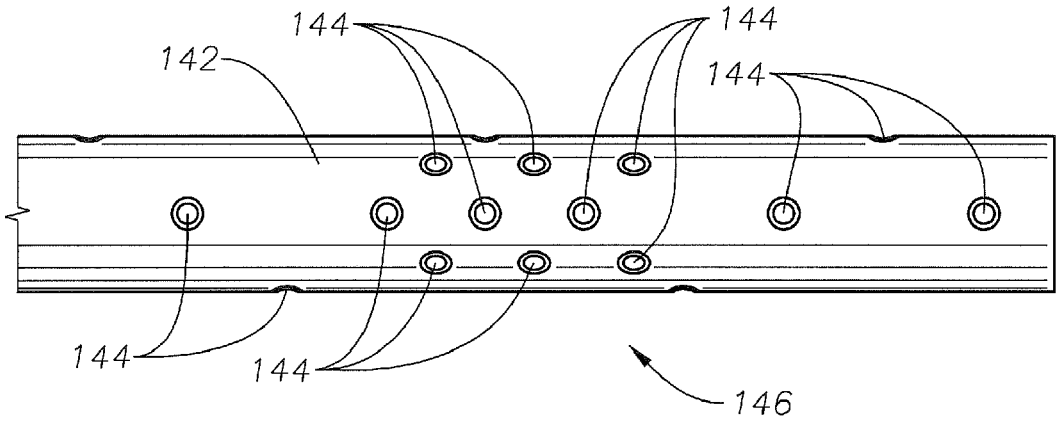
FIG. 6 is a side view of an exemplary embodiment of a portion of the recirculation tube of the apparatus of FIG. 4.

Referring to FIG. 4, in some embodiments, the lateral line 104 is not linear and thus has low spots 146, or dips, and high spots 148. Sand, sediment, and silt may be more likely to settle in low spots 146 than in the high spots 148. Drilling surveys may show a profile of lateral line 104 and thus identify the locations of low spots 146 and high spots 148. Nozzle tubing 142 may have a higher density of apertures 144 in the low spots than in other portions of the lateral line 104 as shown in FIG. 6 where a medial portion of nozzle tubing 142 has a higher density of apertures 144 than outer ends of nozzle tubing 142. For example and referring to FIGS. 4 and 6, nozzle tubing 142 may have three apertures 144 per linear foot in the sections of nozzle tubing 142 that will be placed in low spots 146, while the remainder of nozzle tubing 142 will have only one aperture 144 per linear foot.

Referring back to FIG. 1, some embodiments may use a continuous flow system, wherein ESP 114 constantly recirculates a portion of fluid into nozzle tubing 142 to prevent sand from settling. In these embodiments, a component of the recirculation system such as the recirculation discharge 130, recirculation tube assembly 132, or descending tubing 136 may be sized to define the flow rate through the recirculation system. Alternatively, a flow restrictor (not shown) may be placed within one or more of the elements of the recirculation system.

Some embodiments may not use a continuous flow system. Valve 133, which could be, for example, a hydraulic valve, may selectively allow recirculation fluid to flow to nozzle tubing 142. Valve 133 may have a control above the surface wherein an operator is able to actuate the control above the surface to cause valve 133 at the recirculation discharge to open or close. The control on the surface could be, for example, an electric switch connected by wires to the valve at the recirculation discharge. Alternatively, valve 133 could be a hydraulically actuated valve connected to a surface control by a hydraulic line. The operator may open valve 133 periodically to fluff sand that has settled within lateral line 104, or may open valve 133 at predetermined time intervals. A combination of continuous flow and periodic flow may be used. For example, a percentage of ESP 114 discharge may constantly flow into nozzle tubing 142, and, periodically, an operator or timer (not shown) may boost pressure and flow to fluff or scarify solids that have settled in lateral line 104. The operator may prefer to have a small percentage of flow continuously recirculated and use the pressure boost only in response to a decrease in production flow. A control device (not shown) such as a timer or a computer may be used to actuate the valve at predetermined intervals. Furthermore, a control device (not shown) may be used to actuate the valve responsive to conditions such as flow rate or pressure. In an exemplary embodiment, fluid is able to recirculate and flow freely from nozzle tubing 142 to pump inlet 122 because no packer or wellbore obstruction is located between nozzle tubing 142 and pump inlet 122.

Pumping fluid through a pump such as an ESP 114 tends to heat the fluid. Fluid temperature may increase by 10-15 degrees or more. The increased temperature reduces the viscosity of the fluid. When warmed recirculation fluid passes through apertures 144 into lateral line 104, the reduced viscosity may help loosen settled sand.

Referring to FIG. 1, chemicals may also be used to loosen settled sand or to prevent sand from settling. Capillary line ("cap line") 150, for example, may descend from the surface to recirculation tube assembly 132. Chemicals, such as suspension agents or friction reducers may be injected through cap line 150 into recirculation tube assembly 132, and then carried through recirculation tube assembly 132 to nozzle tubing, where it is sprayed out by nozzles.

Figure 5:
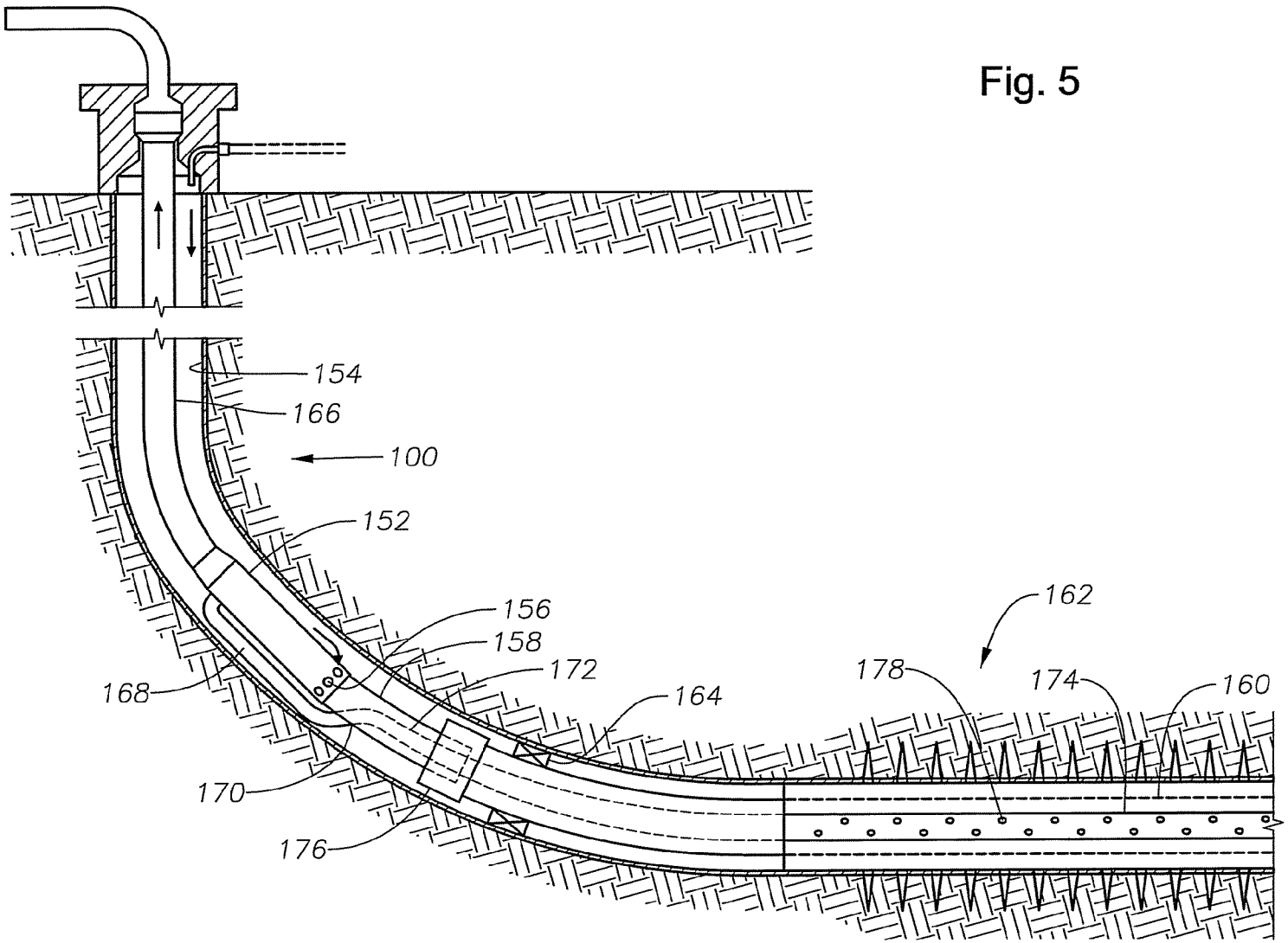
FIG. 5 is a section view of another embodiment of a wellbore fluidizing apparatus.

Referring to FIG. 5, in an alternative embodiment, jet pump 152 may be used to pump wellbore fluids to the surface. In this embodiment, surface water is pumped into casing 154 at the surface to fill casing 154 with pressurized surface water. Surface water enters jet pump 152 at inlet 156. The surface water that enters jet pump 152 flows through an internal nozzle (not shown) creating a venturi effect. The suction created by jet pump 152 draws wellbore fluid up through production tubing 158 from perforated liner 160. Perforated liner 160 is located in lateral line 162. Packer 164 prevents pressurized surface water in casing 154 from reaching lateral line 162.

A portion of the combined wellbore fluid and surface water is pumped up to the surface by tubing 166. The remainder of the combined wellbore fluid and surface water is discharged from jet pump 152 into recirculation diversion tube 168. Recirculation discharge tube 168 descends through wellbore 100 to fitting 170. Fitting 170 passes through the sidewall of production tubing 158 where it connects recirculation diversion tube 170 to lateral tube 172. Lateral tube 172 runs coaxially through production tubing 158 and is in fluid communication with nozzle tubing 174. In a preferred embodiment, fitting 170 engages production tubing 158 above sealbore assembly 176 so that production tubing 158 can be lowered as a stinger and inserted into sealbore assembly 176. Fluid discharged from jet pump 152 into diversion tube 168 ultimately reaches nozzle tubing 174 and passes through apertures 178 to unsettle sand and fines within perforated liner 160.

While the invention has been shown or described in only some of its forms, it should be apparent to those skilled in the art that it is not so limited, but is susceptible to various changes without departing from the scope of the invention.

What is claimed is:

1. An apparatus for fluidizing sand in a wellbore, the apparatus comprising:

a pump assembly having a primary discharge for pumping well fluid up the wellbore and a recirculation discharge through which a portion of the well fluid flows;

a tubing adapted to be placed inside the wellbore, connected to the recirculation discharge and extending farther into the wellbore from the pump assembly;

a plurality of apertures located in the sidewall of the tubing for discharging well fluid into the wellbore to fluidize the sand; and wherein the density of apertures in certain portions of the tubing is greater than in other portions of the tubing.

2. The apparatus according to claim 1, the apparatus further comprising a chemical injection line in communication with the tubing.

3. The apparatus according to claim 1, wherein an intake of the pump assembly is in fluid communication with well fluid discharged from the apertures.

4. The apparatus according to claim 1, wherein the plurality of apertures comprise nozzles distributed along the tubing.

5. The apparatus according to claim 1, wherein each successive aperture occupies a different radial position than a previous aperture.

6. The apparatus according to claim 1, wherein the portion of the tubing containing the apertures has a length of at least 1000 feet.

7. The apparatus according to claim 1, the apparatus further comprising a valve, the valve adapted to selectively flow fluid into the tubing.

8. The apparatus according to claim 1, wherein the recirculation discharge comprises a conduit attached to the tubing by axially inserting a tubular member attached to the recirculation discharge into a receptacle located at one end of the tubing.

9. The apparatus according to claim 1, wherein the pump assembly comprises a centrifugal pump having a plurality of stages of impellers and diffusers, and the recirculation discharge has an inlet at one of the intermediate stages between a first stage and a last stage.

10. The apparatus according to claim 1, wherein the pump assembly comprises a jet pump.

11. A method for fluidizing sand in a wellbore, the method comprising:

(a) creating a plurality of apertures in a length of injection tubing;

(b) inserting the injection tubing into a wellbore;

(c) installing a pump assembly in the wellbore and operating the pump assembly to discharge a primary flow of well fluid up the wellbore;

(d) discharging at least a portion of fluid in the pump assembly into the injection tubing;

(e) discharging well fluid through the plurality of apertures into the wellbore to fluidize accumulated sand; and wherein step (b) occurs before step (c) and in step (c) a recirculation discharge tube of the pump assembly stabs into the injection tubing.

12. The method according to claim 11, wherein the well-fluid discharged through the aperture flows back to an intake of the pump assembly.

13. The method according to claim 11, wherein the pump assembly comprises a centrifugal pump having a plurality of stages of impellers and diffusers and step (a) comprises diverting a portion of the well fluid at an intermediate stage to the injection tubing.

14. The method according to claim 11, further comprising flowing a chemical solution to the injection tubing and discharging the chemical solution from the apertures along with the well fluid.

15. An apparatus for fluidizing sand in a wellbore, the apparatus comprising:

a pump assembly having a primary discharge for pumping well fluid up the wellbore and a recirculation discharge through which a portion of the well fluid flows;

a tubing adapted to be placed inside the wellbore, connected to the recirculation discharge and extending farther into the wellbore from the pump assembly;

a plurality of apertures located in the sidewall of the tubing for discharging well fluid into the wellbore to fluidize the sand; and wherein the recirculation discharge comprises a conduit attached to the tubing by axially inserting a tubular member attached to the recirculation discharge into a receptacle located at one end of the tubing.

16. A method for fluidizing sand in a wellbore, the method comprising:

(a) creating a plurality of apertures in a length of injection tubing;

(b) inserting the injection tubing into a wellbore having a vertical portion and a horizontal portion;

(c) lowering a pump assembly in the wellbore and placing the apertures of the injection tubing adjacent perforations of the wellbore, the injection tubing depending from the pump assembly, (d) operating the pump assembly to discharge a primary flow of well fluid up the wellbore;

(e) discharging at least a portion of fluid in the pump assembly into the injection tubing; and (f) discharging well fluid through the plurality of apertures into the wellbore to fluidize accumulated sand.

17. The method of claim 16, wherein step (c) further comprises lowering the pump assembly into the wellbore, the pump assembly being located in the vertical portion of the wellbore and the injection tubing being located in the horizontal portion of the wellbore.

* * * * *